US011338957B2

(12) United States Patent
Kelly et al.

(10) Patent No.: US 11,338,957 B2
(45) Date of Patent: May 24, 2022

(54) PACKAGING SYSTEM INCLUDING A MULTI-COMPONENT BASE STRUCTURE

(71) Applicant: Daniel Kelly, Medford, NJ (US)

(72) Inventors: Daniel Kelly, Medford, NJ (US); John A. Spadavecchia, Red House, VA (US); James Favaron, Columbia, SC (US)

( * ) Notice: Subject to any disclaimer, the term of this patent is extended or adjusted under 35 U.S.C. 154(b) by 0 days.

(21) Appl. No.: 16/924,568

(22) Filed: Jul. 9, 2020

(65) Prior Publication Data

US 2021/0122522 A1 Apr. 29, 2021

Related U.S. Application Data

(63) Continuation of application No. 13/826,033, filed on Mar. 14, 2013, now abandoned.

(Continued)

(51) Int. Cl.

*B65D 19/00* (2006.01)
*B65B 25/00* (2006.01)

(Continued)

(52) U.S. Cl.

CPC ..... *B65D 19/0004* (2013.01); *B65B 25/00* (2013.01); *B65D 19/0067* (2013.01); *B65D 19/06* (2013.01); *B65D 19/44* (2013.01); *B65D 85/64* (2013.01); *B65D 85/68* (2013.01); *B65D 2519/00034* (2013.01); *B65D 2519/00273* (2013.01); *B65D 2519/00288* (2013.01); *B65D 2519/00293* (2013.01); *B65D 2519/00308* (2013.01); *B65D 2519/00323* (2013.01); *B65D 2519/00333* (2013.01); *B65D 2519/00497* (2013.01); *B65D 2519/00567* (2013.01); *B65D 2519/00621* (2013.01); *B65D 2519/00661* (2013.01); *B65D 2519/00711* (2013.01)

(58) Field of Classification Search

CPC ..... B65D 85/64; B65D 85/68; B65D 81/053; B65D 81/02; B65D 81/022; B65D 81/05; B65D 81/113; B65D 81/107; B65D 19/0002; B65D 19/40; B65D 19/0075; B65D 2519/00338

USPC ..... 108/57.17, 56.1; 206/386, 523, 586, 587

See application file for complete search history.

(56) References Cited

U.S. PATENT DOCUMENTS 2,109,784 A * 3/1938 Shepard, Jr. ..... B65D 19/0075 108/57.24
3,471,116 A * 10/1969 Cherrie ..... B65D 19/00 410/46

(Continued)

*Primary Examiner* — Robert Poon

(74) *Attorney, Agent, or Firm* — Massina Pat. & TM Law PLLC

(57) ABSTRACT

A pallet base structure including a center deck defining a support surface extending between opposed sides and having at least two lugs extending from each of the opposed sides. A pair of base side members are positioned along respective sides of the center deck. Each base side member has first and second spaced apart base legs and a support member extending between the base legs with at least two corresponding lug receiving slots defined in the support member. The respective lugs are received in the respective lug receiving slots such that the center deck support surface is aligned with an upper surface of each support member to define a planar pallet surface. A packaging system incorporating the pallet base structure is also described.

15 Claims, 14 Drawing Sheets

Related U.S. Application Data

(60) Provisional application No. 61/665,336, filed on Jun. 28, 2012.

(51) Int. Cl.

| | |
|---|---|
| ***B65D 85/64*** | (2006.01) |
| ***B65D 85/68*** | (2006.01) |
| ***B65D 19/44*** | (2006.01) |
| ***B65D 19/06*** | (2006.01) |

(56) References Cited

U.S. PATENT DOCUMENTS 4,148,394 A * 4/1979 Bederman ..... B65D 71/0092 108/56.3
4,550,830 A * 11/1985 Shuert ..... B65D 19/06 206/386
4,801,024 A * 1/1989 Flum ..... A47F 7/281 108/53.1
5,249,678 A * 10/1993 Traina ..... B65D 81/02 206/320
5,829,595 A * 11/1998 Brown ..... B65D 19/0018 206/600
7,347,328 B2 * 3/2008 Hartwall ..... B65D 19/18 206/600
2003/0141300 A1 * 7/2003 French ..... B65D 21/0204 220/23.4
2005/0016999 A1 * 1/2005 Richardson ..... B65F 1/1607 220/4.28
2006/0113214 A1 * 6/2006 Shimizu ..... B65D 81/107 206/576
2007/0131147 A1 * 6/2007 Brubaker ..... B65D 85/68 108/56.1
2008/0250987 A1 * 10/2008 Hartel ..... B65D 19/0073 108/57.12
2010/0095875 A1 * 4/2010 Hailston ..... B65D 19/0028 108/57.29

* cited by examiner

PACKAGING SYSTEM INCLUDING A MULTI-COMPONENT BASE STRUCTURE

This application is continuation of U.S. application Ser. No. 13/826,033, filed Mar. 14, 2013, which claims the benefit of U.S. Prov. Appln. No. 61/665,336, filed Jun. 28, 2012, the contents of each of which are incorporated by reference.

FIELD OF THE INVENTION

This invention relates to a packaging system for moving freestanding devices. In particular, this invention relates to a packaging system including a multi-component base structure with a center deck configured such that it can be utilized to support the freestanding device during movement.

BACKGROUND OF THE INVENTION

Freestanding devices are utilized in many industries. The devices include a housing supported on a number of legs, typically four, which depend from the housing. The housing encloses equipment for a given application, for example, food or beverage vending equipment, computer kiosks, automated teller assemblies, or rental equipment as a few examples. A specific example is a freestyle fountain vending machine which has a beverage dispenser, touch-screen input, computer controller, and fountain beverages all housed within the housing. FIGS. 1-4 illustrate two exemplary freestyle fountain vending machines packaged within a packaging system in accordance with the present invention. The exemplary freestyle fountain vending machines each include four legs (not shown) which support the housing a given distance off the floor or other support system.

The freestanding devices are typically manufactured by a manufacturer in a manufacturing facility with all of the equipment assembled into the housing such that the device requires minimal setup once delivered to a use location. Additionally, the housing is often finished with a desired look, for example, company branding or matching the décor of the use location. The freestanding device is delivered from the manufacturing facility to the use location, is set in position, and final connections, for example connection to a power supply and/or network, are made to activate the device.

Since the housing is often finished and houses potentially delicate equipment, it is desirable to deliver the freestanding device in a secure manner which protects the housing and the equipment inside thereof. It is also desirable to utilize packaging which allows easy transport of the device. It is further desirable to utilize packaging which is easy to remove without significant effort.

SUMMARY OF THE INVENTION

Briefly, the present invention provides a packaging system including a multi-component base structure with a center deck configured such that it can be utilized to support the freestanding device during movement.

In one aspect, the invention provides a pallet base structure including a center deck defining a support surface extending between opposed sides and having at least two lugs extending from each of the opposed sides. A pair of base side members are positioned along respective sides of the center deck. Each base side member has first and second spaced apart base legs and a support member extending between the base legs with at least two corresponding lug receiving slots defined in the support member. The respective lugs are received in the respective lug receiving slots such that the center deck support surface is aligned with an upper surface of each support member to define a planar pallet surface.

In another aspect, the invention provides a packaging system incorporating a pallet base structure including a center deck defining a support surface extending between opposed sides and having at least two lugs extending from each of the opposed sides. A pair of base side members are positioned along respective sides of the center deck. Each base side member has first and second spaced apart base legs and a support member extending between the base legs with at least two corresponding lug receiving slots defined in the support member. The respective lugs are received in the respective lug receiving slots such that the center deck support surface is aligned with an upper surface of each support member to define a planar pallet surface. A cover member is configured to be positioned spaced from the pallet base structure and at least one strap member is configured to extend about the pallet base structure and the cover member such that the pallet base structure and the cover member are an interconnected unit.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
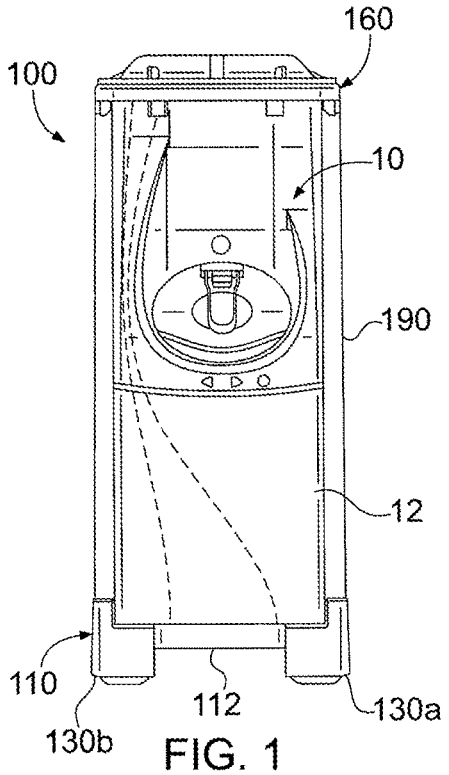
FIG. 1 is a front elevation view of a packaging system in accordance with an embodiment of the present invention positioned about an exemplary freestanding device.
Figure 2:
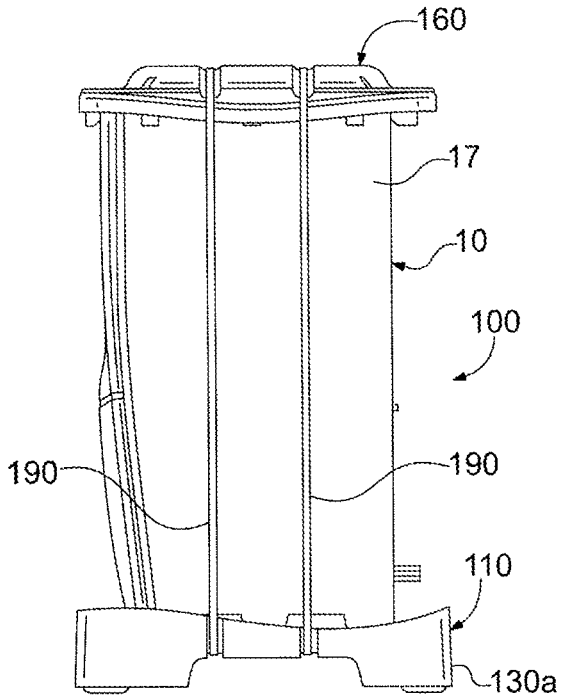
FIG. 2 is a side elevation view of the assembly of FIG. 1.
Figure 3:
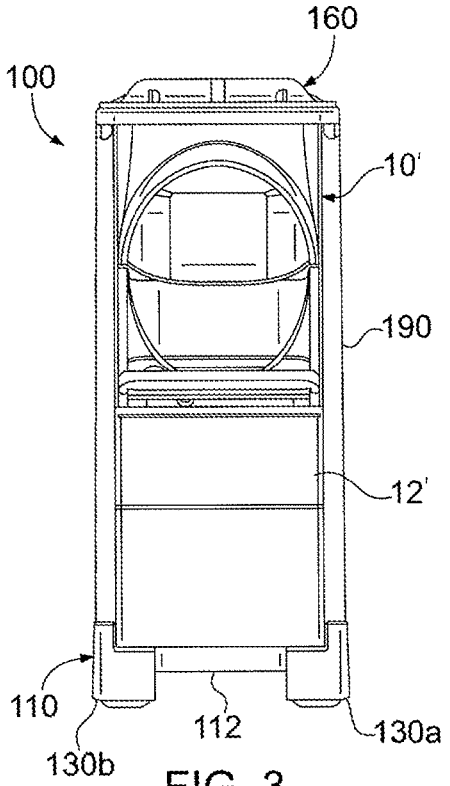
FIG. 3 is a front elevation view of a packaging system in accordance with an embodiment of the present invention positioned about another exemplary freestanding device.
Figure 4:
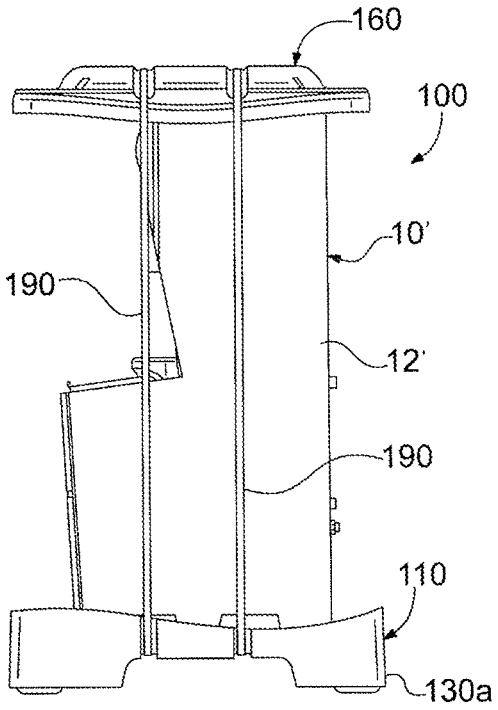
FIG. 4 is a side elevation view of the assembly of FIG. 3.
Figure 5:
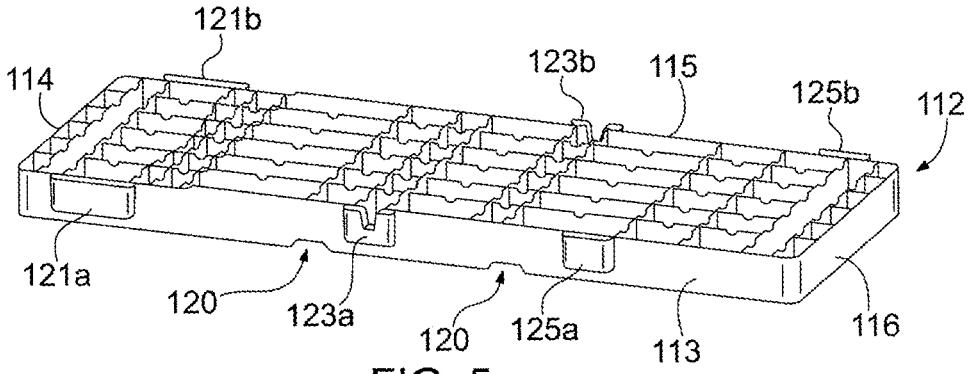
FIG. 5 is a perspective view of an exemplary base center deck in accordance with an embodiment of the invention.
Figure 6:
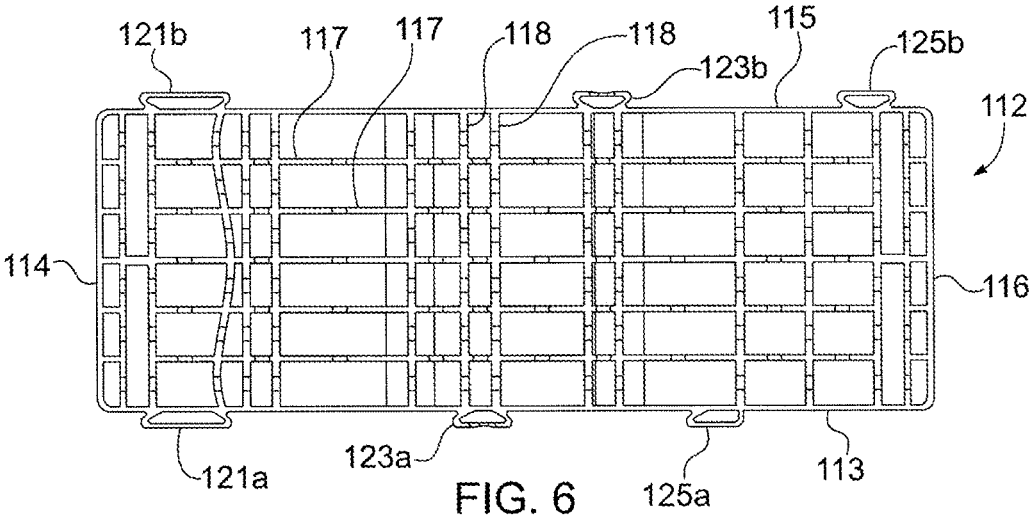
FIG. 6 is a top plan view of the exemplary base center deck of FIG. 5.
Figure 7:
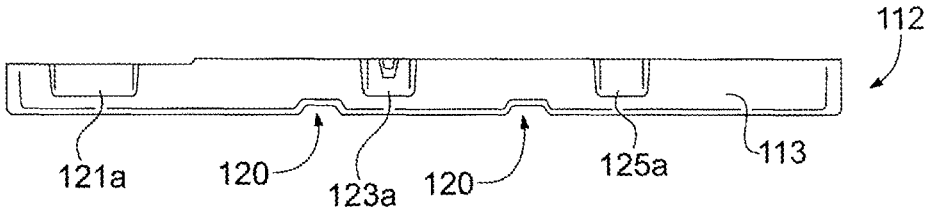
FIG. 7 is a left side elevation view of the exemplary base center deck of FIG. 5.

In the drawings, like numerals indicate like elements throughout. Certain terminology is used herein for convenience only and is not to be taken as a limitation on the present invention. For example, the terms front, back, left and right are utilized herein to assist with understanding of relative positioning, but are not intended to be limiting to an orientation of use of the device. The following describes a preferred embodiment of the present invention. However, it should be understood, based on this disclosure, that the invention is not limited by the preferred embodiment described herein.

Referring to FIGS. 1-4, an exemplary embodiment of a packaging system 100 is shown positioned relative to exemplary freestanding devices 10, 10'. The packaging system 100 of the present embodiment generally includes a base structure 110, a cover member 160 and a pair of straps 190. In the illustrated assembled condition, the freestanding device 10, 10' is positioned with its legs (not shown) positioned within the base structure 110 and the cover member 160 is positioned on top of the housing 12, 12'. As shown, the housings 12, 12' may have varying configurations, with the base structure 110 and the cover member 160 configured to correspond to the specific housing 12, 12' structure. The straps 190 extend about the base structure 110 and the cover member 160 and secure them as a unit in the assembled condition. As illustrated in FIGS. 1-4, the housing 12, 12' preferably has a length and width less than that of the base structure 110 and cover member 160 such that the housing 12, 12' is recessed from the edges of the packaging system 100, thereby protecting the device 10, 10' from bumps or the like during transport. As illustrated in FIGS. 20-23, wall structures 180 may also be utilized to further protect the devices 10, 10' as described in more detail hereinafter.

Referring to FIGS. 5-8, an exemplary base center deck 112 will be described. The base center deck 112 includes side walls 113, 115 extending between a front wall 114 and a rear wall 116. A series of longitudinal and lateral ribs 117, 118 extend between the walls 113-116 to define the deck structure. A pair of strap guide slots 120 extend along the bottom surface of the deck 112 in the lateral direction. The rib structure is preferably manufactured from a polymeric material to provide a light weight yet sufficiently strong structure, however, other materials may be utilized. Additionally, while the deck 112 is illustrated with an open rib structure, other structures, for example, a solid structure, a plank structure or a planar structure may be utilized. Similarly, while the exemplary deck 112 has a rectangular configuration, other configurations may be utilized.

A series of lugs 121*a*, 123*a*, 125*a* extend from the left side wall 113 and a series of lugs 121*b*, 123*b*, 125*b* extend from the right side wall 115. The lugs 121*a*, 123*a*, 125*a* are configured to be received in corresponding slots 141, 143, 145 in the left base side member 130*a* and the lugs 121*b*, 123*b*, 125*b* are configured to be received in corresponding slots 141, 143, 145 in the left base side member 130*b* as described in more detail below. The illustrated lugs 121, 123, 125 have a dovetail configuration, narrowing moving from the top surface of the deck 112 toward the bottom surface thereof, however, they may have other configurations. The lugs 121, 123, 125 have a height $l$ which is preferably less than the height H of the deck 112. While lugs and corresponding receiving slots are described herein for releasably interconnecting the center deck 112 with the base members 130*a*, 130*b*, the invention is not limited to such and other releasable connection members, for example, clamps, screws, pegs, dowels or the like may be used.

Figure 8:
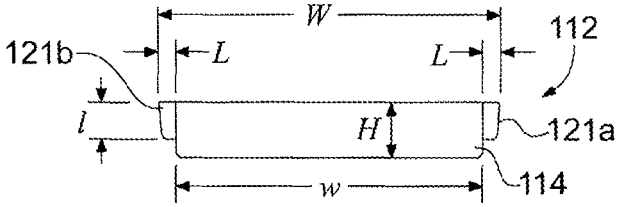
FIG. 8 is a front elevation view of the exemplary base center deck of FIG. 5.

As indicated in FIG. 8, the deck 112 has a width w between the side walls 113, 115 which is less than the overall width W of the deck 112. The overall width W of the deck 112 is equal to the width w plus the distance L the lugs 121-125*a*, 121-125*b* extend from the side walls 113, 115. In the illustrated embodiment, the front lugs 121*a* and 121*b* are longitudinally aligned while the mid lugs 123*a* and 123*b* are longitudinally offset and the rear lugs 125*a* and 125 are longitudinally offset. The relationship of the offsets and the widths w, W to the configuration of the device 10, 10' will be described with reference to FIGS. 5-8 and 24*a*-*h*.

Figure 24A:
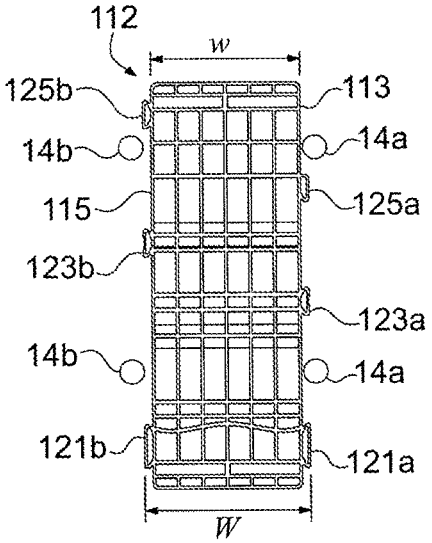
FIG. 24*a*-24*h* are top views illustrating sequential removal of the base center deck relative to the freestanding device legs in accordance with an exemplary embodiment of the invention.
Figure 24B:
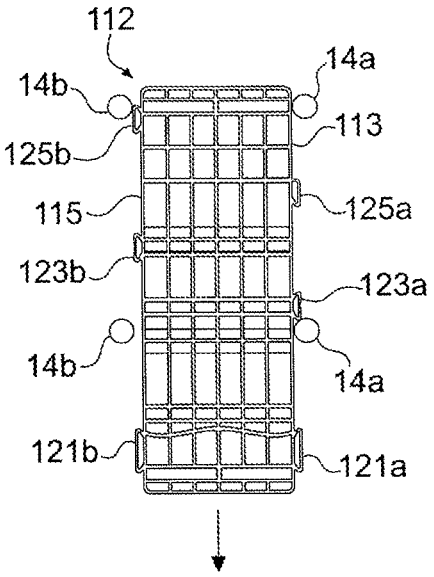
Figure 24C:
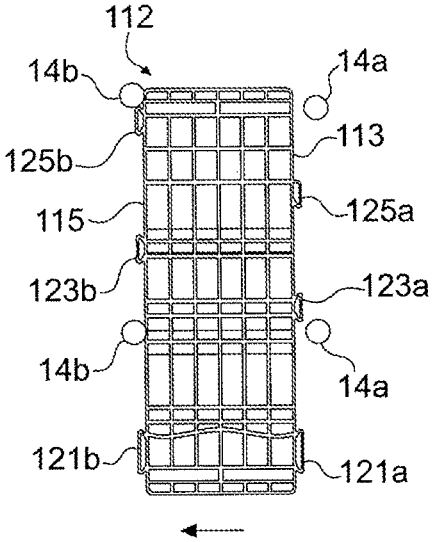
Figure 24D:
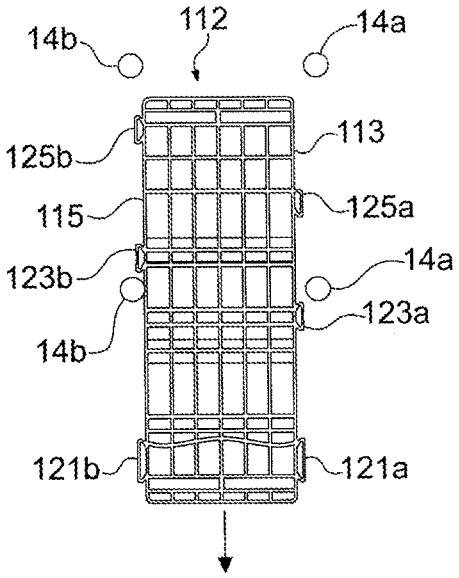
Figure 24E:
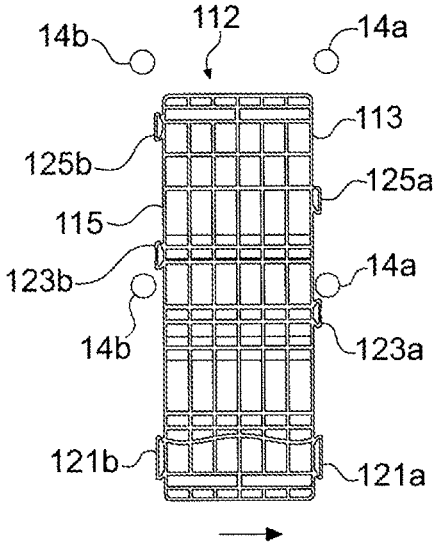
Figure 24F:
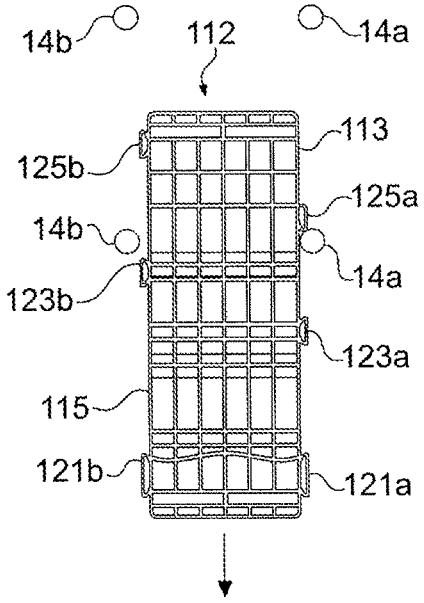
Figure 24G:
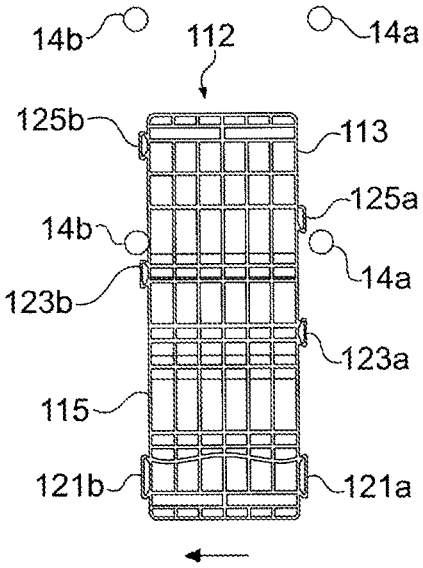
Figure 24H:
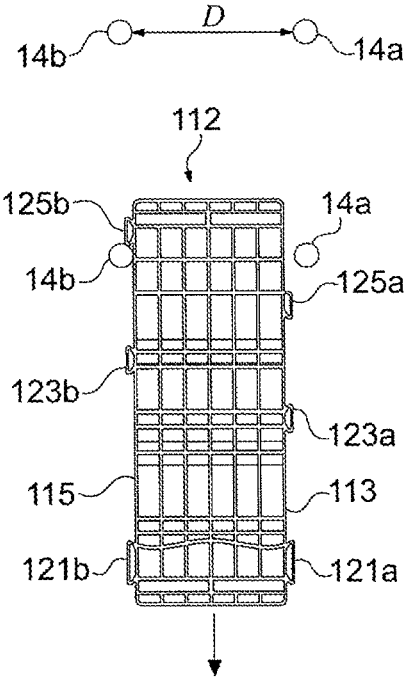

FIG. 24*a* illustrates the longitudinal position of the deck 112 relative to the legs 14*a*, 14*b* of a freestanding device 10, 10' as the deck 112 would be positioned during transport. The legs 14*a* on one side of the device 10, 10' are laterally spaced from the legs 14*b* on the opposite side of the device 10, 10' by a distance D as indicated in FIG. 24*h*. In a preferred embodiment, the distance D is smaller than the total width W, but larger than the width w plus the distance $l$ of one of the lugs 121, 123, 125. With such a configuration, including the lug offsets, the deck 112 provides as great as possible of a support width w while still being slidable in a longitudinal direction to be removed from between the legs 14*a*, 14*b*. Such slidability allows the center deck 112 to be removed with the legs 14*a*, 14*b* already positioned on a support surface, i.e., the housing 12, 12' does not have to be lifted to remove the center deck 112. Alternatively, the total width W can be made to be smaller than the distance D, whereby the deck 112 may be easily slid out from between the legs 14*a*, 14*b*, however, such a configuration reduces the support width w of the center deck 112. It is noted that since the forward lugs 121*a*, 121*b* are already forward of the front legs 14*a*, 14*b*, the lugs 121*a*, 121*a* of the illustrated embodiment are longitudinally aligned without concern for passage between the legs 14*a*, 14*b*.

Removal of the illustrated center deck 112 will be described with reference to FIGS. 24*a*-24*h*. In the initial step illustrated in FIG. 24*a*, the deck 112 is moved laterally such that the side 113 contacts the legs 14*a*. In this position, the opposite lugs 123*b* and 125*b* are laterally clear of the legs 14*b*. The deck 112 is moved forward as indicated by the arrow in FIG. 24*b* until the mid lug 123*a* contacts the forward leg 14*a*. The deck 112 is then moved laterally as indicated by the arrow in FIG. 24*c* until the side 115 contacts the legs 14*b*. In this position, the opposite lugs 123*a* and 125*a* are laterally clear of the legs 14*a*. The deck 112 is moved forward as indicated by the arrow in FIG. 24*d* until the mid lug 123*b* contacts the forward leg 14*b*, with the lug 123*a* clearing the legs 14*a*. The deck 112 is then moved laterally as indicated by the arrow in FIG. 24*e* such that the side 113 contacts the legs 14*a*. In this position, the opposite lugs 123*b* and 125*b* are laterally clear of the legs 14*b*. The deck 112 is moved forward as indicated by the arrow in FIG. 24*f* until the rear lug 125*a* contacts the forward leg 14*a*, with the lug 123*b* clearing the legs 14*b*. The deck 112 is then moved laterally as indicated by the arrow in FIG. 24*g* until the side 115 contacts the legs 14*b*. In this position, the opposite lug 125*a* is laterally clear of the legs 14*a*. The deck 112 is moved forward as indicated by the arrow in FIG. 24*h* until the rear lug 125*b* contacts the forward leg 14*b*, with the lug 125*a* clearing the legs 14*a*. With one last lateral movement and forward movement (not shown), the lug 125*b* is clear of the legs 14*b* and the center deck 112 is removed. The center deck 112 is positioned under a device by reversing this procedure.

Figure 10:
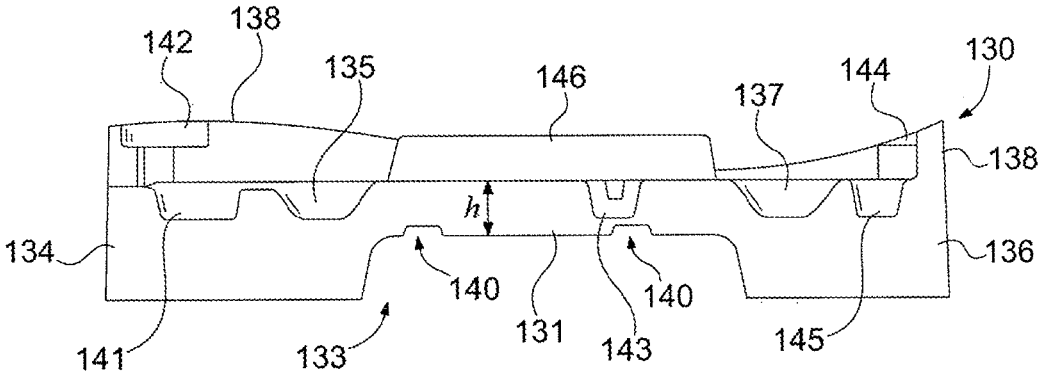
FIG. 10 is an elevation view of the exemplary right base side member of FIG. 9.
Figure 11:
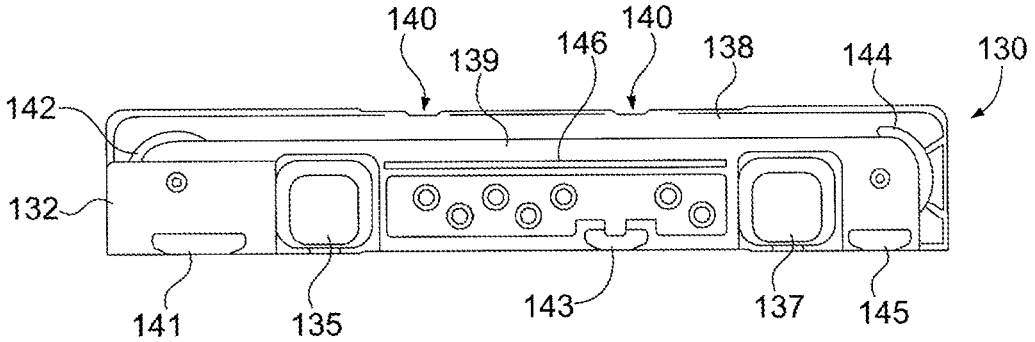
FIG. 11 is a top plan view of the exemplary right base side member of FIG. 9.
Figure 12:
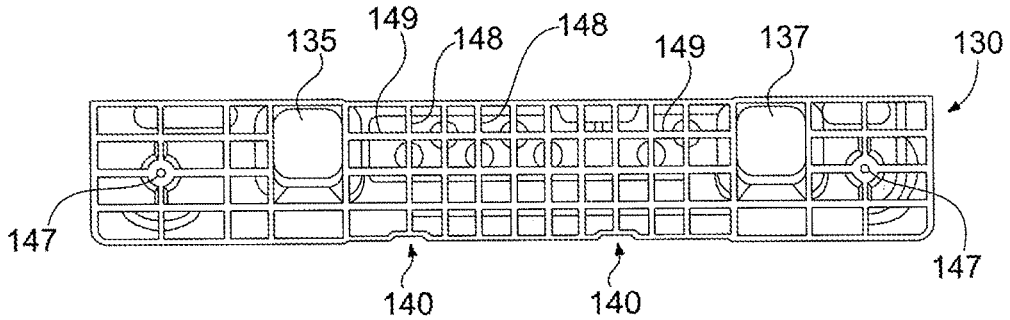
FIG. 12 is a bottom plan view of the exemplary right base side member of FIG. 9.

Referring to FIGS. 9-15, the base side members 130 and the interconnection of the center deck 112 therewith will be described. FIGS. 9-12 show the right base side member 130*a*, with the left base side member 130*b* preferably being a mirror image thereof. The base side member 130 includes a support member 132 extending longitudinally from front to back. The support member 123 is supported by a front base leg 134 and a rear base leg 136 with a longitudinal space 133 therebetween. A bridge portion 131 of the support member 132 bridges between the legs 134, 136 over the longitudinal space 133. Support strap slots 140 extend laterally along the lower surface of the bridge portion 131 and are configured to longitudinally align with the strap slots 120 of the base center deck 112. The bridge portion 131 preferably has a height h which is equal to a height H of the deck 112 to further align the slots 120, 140. An upper wall 138 extends upward from the support member 132 along the side and rear edges thereof. The slots 140 may extend along the outer surface of the wall 138. As illustrated in FIG. 12, the support member 132, the base legs 134, 136 and the wall 138 are supported by a series of lateral and longitudinal ribs 148, 149. Again, while a rib structure is defined, the invention is not limited to such.

Each base side member 130 includes a series of lug receiving slots 141, 143, 145 defined along the support member 132. The slots 141, 143, 145 are longitudinally positioned such that they align with and receive the respective lugs 121*a*, 123*a*, 125*a* or 121*b*, 123*b*, 125*b*. The illustrated slots 141, 143, 145 have a dovetail configuration corresponding to that of the lugs 121, 123, 125, however, they may have other configurations. The slots 141, 143, 145 have a depth such that the lugs 121, 123, 125 are received and stopped with the upper surface of the center deck 112 flush with the upper surface of the support member 132.

Figure 13:
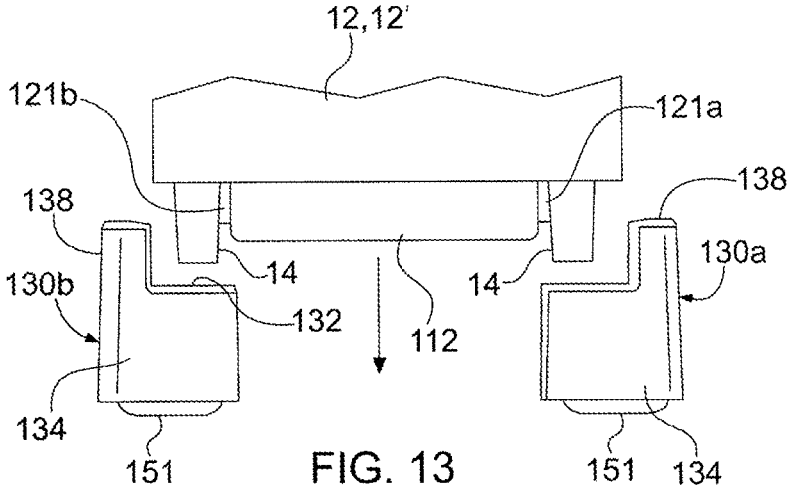
FIG. 13 is a perspective view of an exemplary cover member in accordance with an embodiment of the invention.
Figure 14:
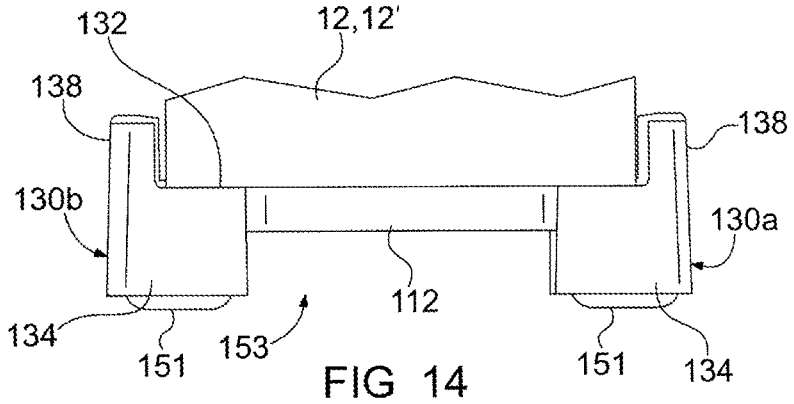
FIG. 14 is a top plan view of the exemplary cover member of FIG. 13.

A pair of leg receiving openings 135 and 137 are defined into the support member 132. Each opening 135, 137 is preferably longitudinally positioned within a respective leg 134, 136 such that legs 14 received in the openings 135, 137 remain clear of the base side member longitudinal space 133. The openings 135, 137 are preferably tapered inward to assist in guiding the legs 14 into the openings 135, 137 which also assists in aligning the lugs 121, 123, 125 with the respective slots 141, 143, 145. As illustrated in FIGS. 13 and 14, the center deck 112 is preferably positioned under the device housing 12, 12' and lifted using a pallet jack or the like. The base side members 130*a*, 130*b* are moved into position relative to the raised housing 12, 12' and legs 14. The upper wall 138 may contact the legs 14 to provide an initial macro positioning. As the center deck 112 is lowered, the legs 14 enter the openings 135, 137 with the taper of the openings 135, 137 causing the base side members 130*a*, 130*b* to move into a more precise alignment. As the deck 112 is continued to be lowered, the dovetail configuration of the slots 141, 143, 145 and the corresponding lugs 121, 123, 125 guide the deck 112 into final mating position with the base side members 130*a*, 130*b*. The deck 112 is lowered until the tugs 121, 123, 125 are fully received in the slots 141, 143, 145 as illustrated in FIG. 14. The openings 135, 137 preferably have a depth approximately equal to the height of the legs 14 such that the legs 14 contact the bottom of the openings 135, 137 at the same time the housing 12, 12' contacts the upper surface of the deck 112 and support members 132. The base structure 110 is thereby fully assembled with a lateral space 153 between the base side members 130*a*, 130*b*.

Figure 15:
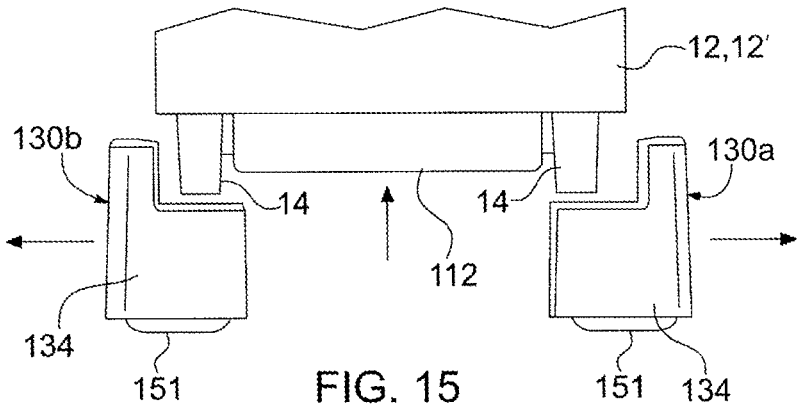
FIG. 15 is a side elevation view of the exemplary cover member of FIG. 13.

In this configuration, the device 10, 10' may be moved by positioning a pallet jack or the like laterally through the longitudinal opening 133, however, it is preferred that the cover member 160 is secured with the straps 190 before movement. To remove the base structure 110 from the device 10, 10', a pallet jack or the like is positioned longitudinally through the lateral opening 153 and the center deck 112 is lifted until the legs 14 clear the openings 135, 137, at which point the lugs 121, 123, 125 have already cleared the slots 141, 143, 145, and the base side members 130*a*, 130*b* are removed as indicated in FIG. 15. The center deck 112 is then lowered and removed in the manner described with reference to FIGS. 24*a*-24*h*.

Figure 9:
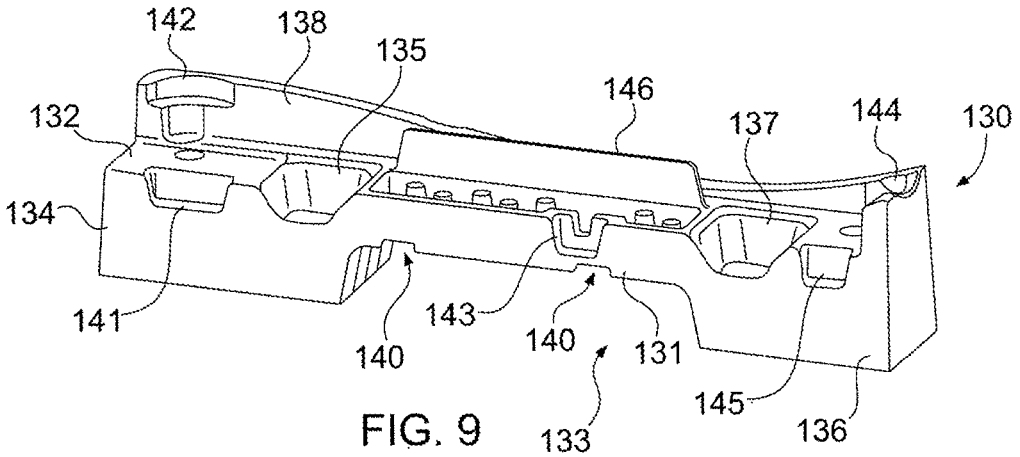
FIG. 9 is a perspective view of an exemplary right base side member in accordance with an embodiment of the invention.
Figure 21:
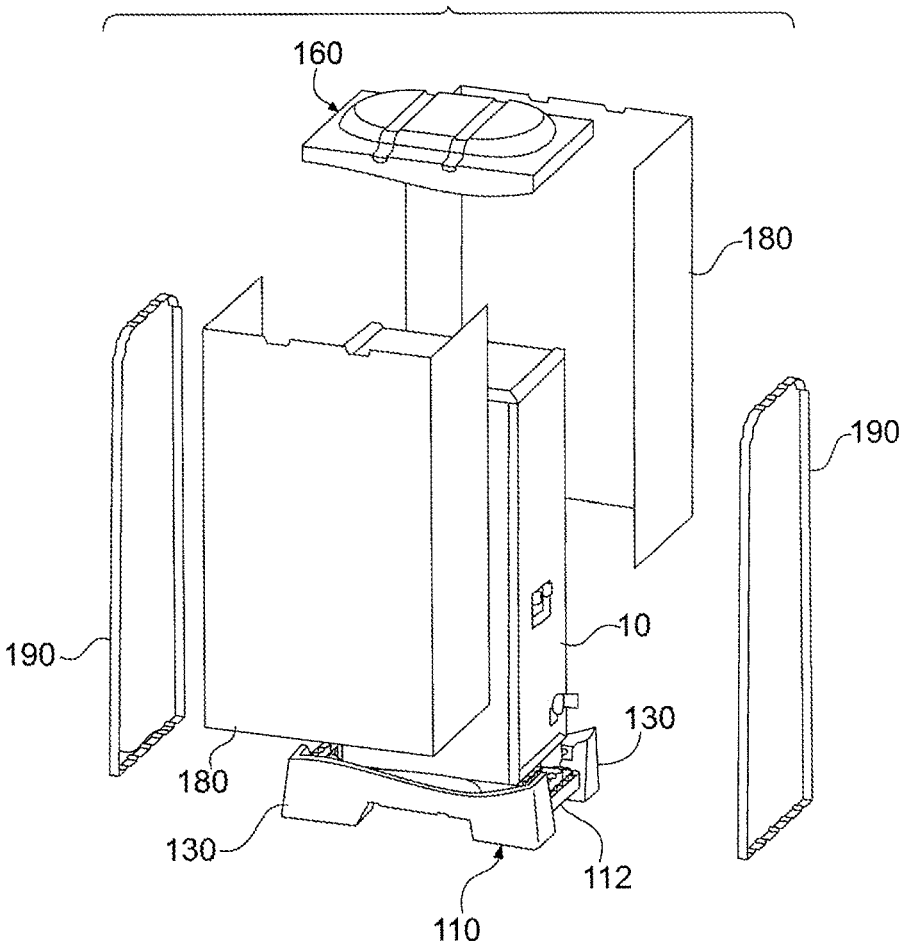

Referring to FIGS. 9-11, the base side members 130*a*, 130*b* preferably define a wall receiving configuration. In this regard, an inner wall guide 146 extends upward from the bridge portion 131 opposite the upper wall 138 such that a wall receiving slot 139 is defined therebetween. A lower portion of a wall 180, see FIG. 21, is received within the slot 139 and the inner wall guide 146 prevents the wall 180 from pressing against the device housing 12, 12' when the straps 190 are attached.

Referring to FIGS. 13-15, the base side members 130 may be provided with shock dampeners 151 along the lower surface of each base leg 134, 136. Holes 147 may be provided in each base leg 134, 136 for securing the dampeners 151, although other connection mechanisms may be utilized. The shock dampeners 151 have an elastomeric structure which helps to reduce shock and vibration experienced by the device 10, 10' when being transported. The shock dampeners 151 may have various configurations, for example, they may be solid structures manufactured from an elastomeric material or fluid filled which is either sealed or fillable. Referring to FIGS. 9-11, in the illustrated embodiment, the upper wall 138 includes recesses 142, 144 configured to receive the shock dampeners 151 of a base side member 130 which may be stacked thereon, for example, during storage.

Figure 16:
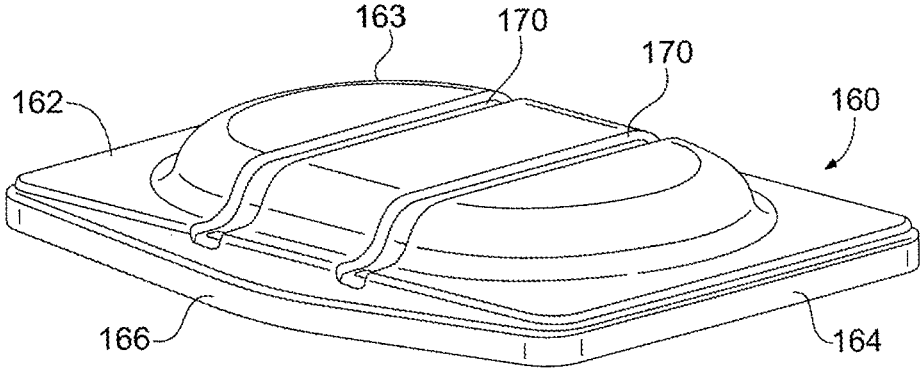
FIG. 16 is a front elevation view illustrating positioning of the exemplary base center deck relative to the exemplary base side members.
Figure 17:
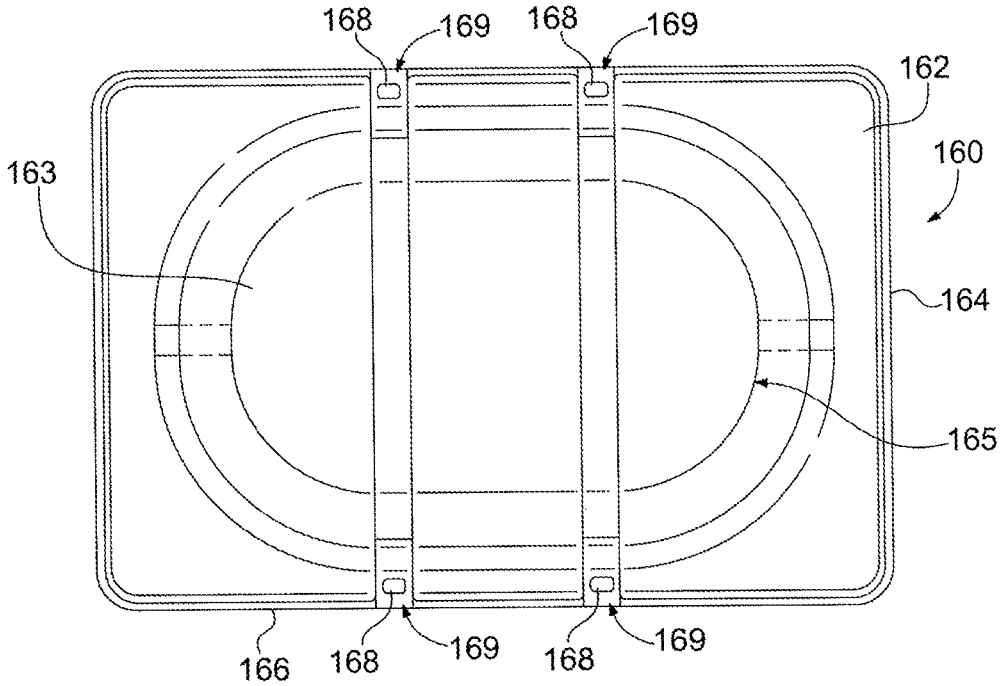
FIG. 17 is a front elevation view similar to FIG. 16 and illustrating the base center deck and the freestanding device thereon positioned relative to the base side members.
Figure 18:
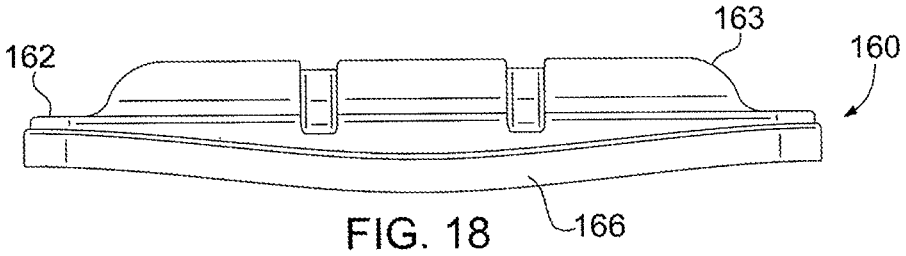
FIG. 18 is a front elevation view similar to FIG. 16 illustrating removal of the base side members.

Referring to FIGS. 16-18, an exemplary cover member 160 will be described. The exemplary cover member 160 includes a planar portion 162 with a raised center portion 163. The raised center portion 163 defines a concave internal space 165 configured to receive the upper portion of the device housing 12, 12'. The raised center portion 163 may have a stepped configuration to facilitate use with different housing configurations. A pair of strap slots 170 extend laterally across the raised center portion 163 and are positioned to align with the strap slots 120, 140 upon assembly.

A rim 164 depends from the perimeter of the planar portion 162, with the lateral sides of the rim 164 defining an extended portion 166. Inside the extended portion 166, a number of wall projections 168 extend from the inside surface of the planar portion 162 such that a wall receiving slot 169 is defined between the projections 168 and the inside surface of the extended portion 166. An upper portion of the wall 180, see FIG. 21, is received within the slot 169.

Figure 19:
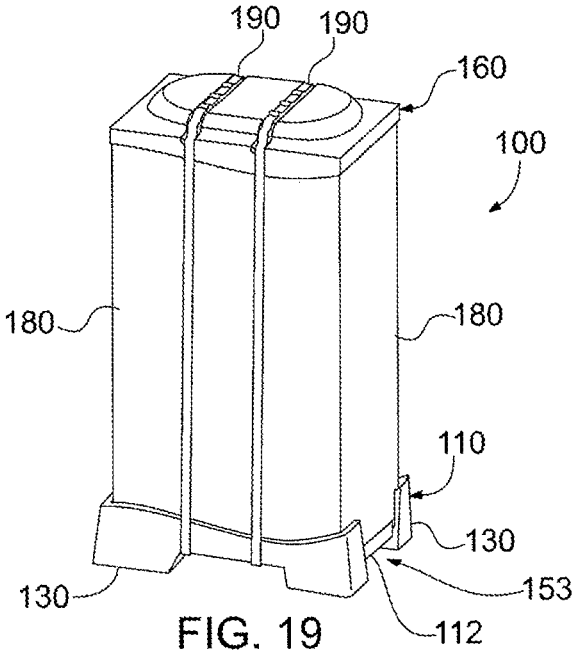
FIG. 19 is a perspective view illustrating an assembled packaging system in accordance with an embodiment of the invention.

When a freestanding device 10, 10' is ready for transport, the device is first positioned with respect to the base structure 110 as described with reference to FIGS. 13 and 14. If utilized, the wall 180 is positioned such that the lower portion of the wall 180 is received in the slots 139 defined by the base side members 130. The cover member 160 is then positioned on top of the device housing 12, 12' with the upper portion thereof received in the concave internal space 165 and the upper portion of the wall 180 is received within the slot 169. Straps 190 are secured around the base structure 110 and the cover member 160, received in the respective slots 120, 140, 170. The freestanding device is thereby secured within the packaging system 100 as illustrated in FIG. 19. The device can be delivered with reduced chance of damage and can be moved proximate to its final use location via a pallet jack positioned through the lateral space 153.

Figure 20:
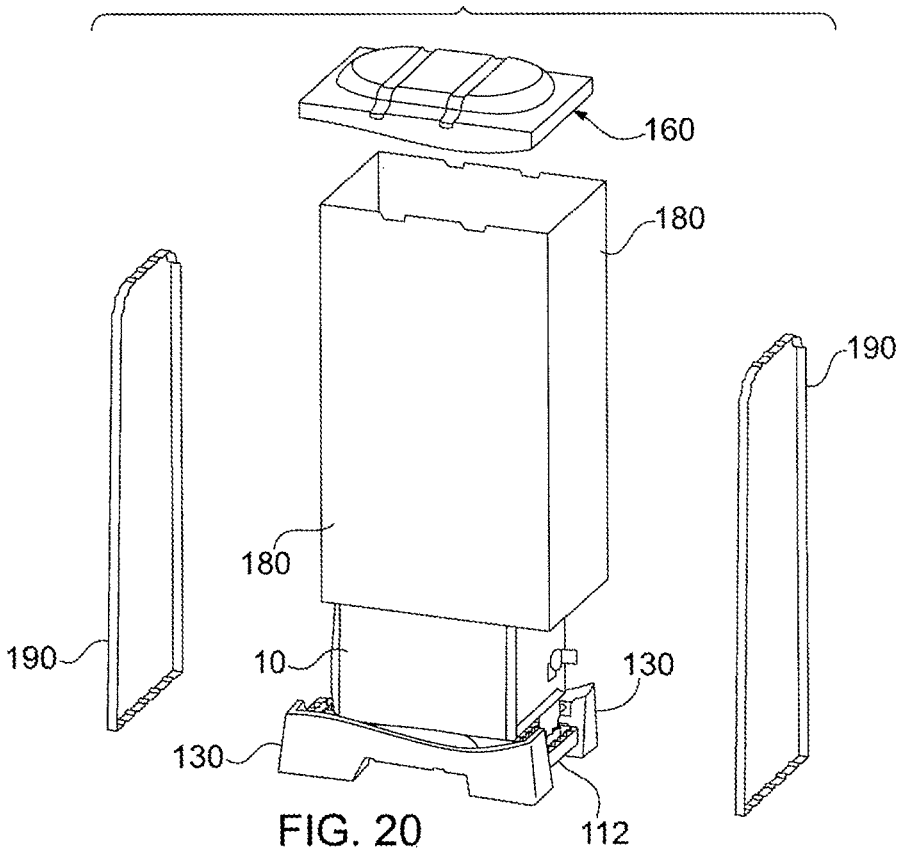
FIGS. 20-23 are perspective views similar to FIG. 19 illustrating the sequential disassembly of the packaging system relative to the freestanding device positioned therein.
Figure 22:
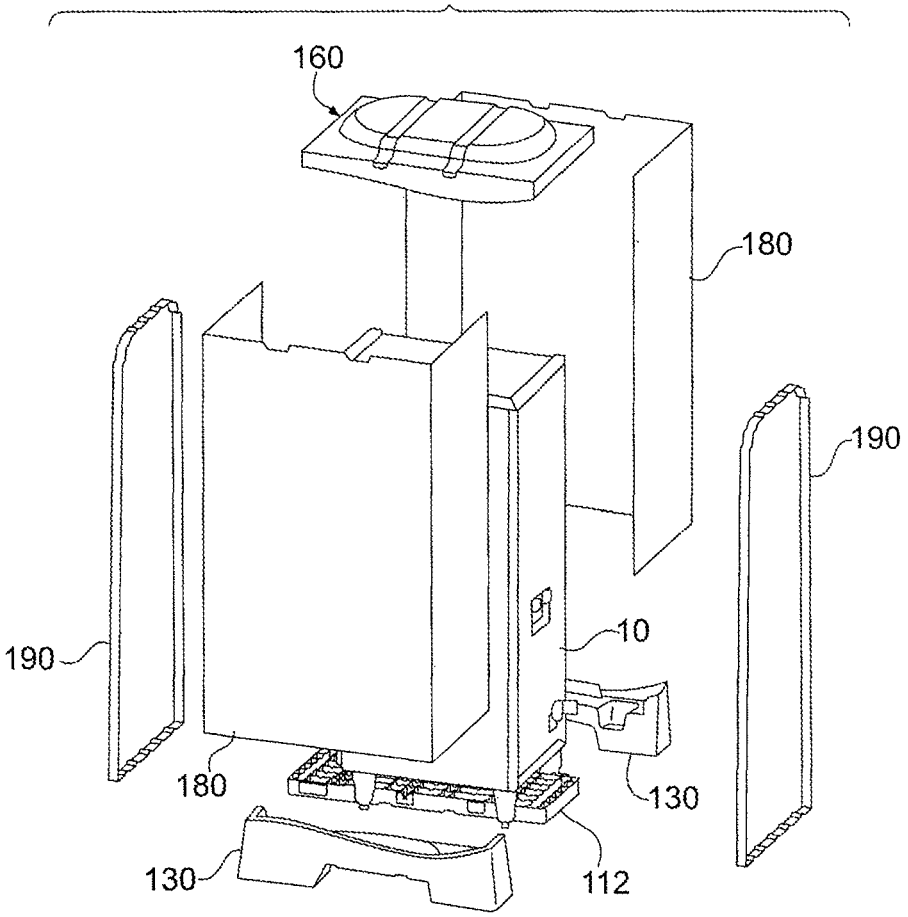
Figure 23:
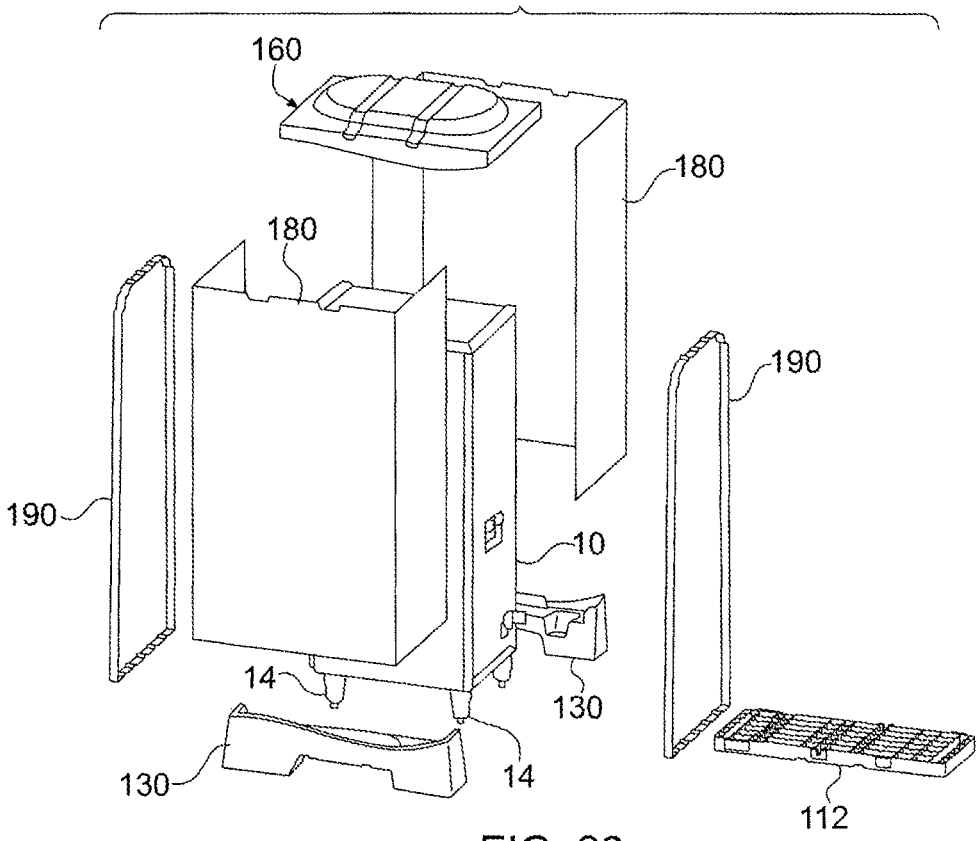

Once delivered, the freestanding device 10, 10' may be easily unpacked from the packaging system 100 in the manner illustrated in FIGS. 20-23. First, as illustrated in FIG. 20, the straps 190 are released, for example, by cutting which allows the cover member 160 to be lifted off and the walls 180 lifted out of the slots 139 in the base side members 130. The walls 180 are then separated and removed as illustrated in FIG. 21. The freestanding device 10 is simply supported by the base structure 110. A pallet jack or the like is then used to lift the center deck 112 as previously described with reference to FIG. 15. Once the legs 14 clear, the base side members 130 are easily removed and the device 10 lowered until the legs 14 are on the floor as illustrated in FIG. 22. Referring to FIG. 23, the center deck 112 is then removed. The process described with reference to FIGS. **24*a*-24*h* may be utilized if necessary. The device 10 is easily unpackaged without any tools other than a tool used to remove the straps 190**.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A pallet base structure comprising:

a center deck having opposed side surfaces at the lateral extents thereof and defining a support surface and an opposite contact surface extending between the opposed side surfaces, the center deck having a first height between the contact surface and the support surface;

a pair of base side members, each base side member having an upper surface and a lower surface, each base side member having a second height, which is larger than the first height, defined between the upper and lower surfaces, and at least one leg receiving opening defined into each upper surface; and at least two connection members, each connection member configured to releasably connect a respective base side member with the center deck such that the center deck contact surface is spaced in the height direction from the base side members lower surfaces and each of the leg receiving openings is positioned laterally outward of the lateral extents of the center deck.

2. The pallet base structure of claim 1 wherein upon connection of the base side members to the center deck, the center deck support surface is aligned with the upper surface of the respective base side members to define a planar pallet surface.

3. The pallet base structure of claim 1 wherein the connection members are selected from the group comprising clamps, screws, pegs, dowels and lugs.

4. The pallet base structure of claim 1 wherein at least two lug receiving slots are defined in the upper surface of each support member, and wherein the connection members are defined by corresponding lugs extending from the opposed side surfaces of the center deck.

5. The pallet base structure of claim 4 wherein each lug has a dovetail configuration and each lug receiving slot has a corresponding dovetail configuration.

6. The pallet base structure of claim 4 wherein the at least one of the lugs on one side of the center deck is longitudinally offset from a corresponding lug on the opposite side of the center deck.

7. The pallet base structure of claim 4 wherein three lugs extend from each of the opposed side surfaces of the center deck and wherein a forward most lug a first of the sides of the center deck is longitudinally aligned with a forward most lug on the opposite second side of the deck and the remaining lugs on the first side of the center deck are longitudinally offset from the remaining lugs on the second side of the center deck.

8. The pallet base structure of claim 4 wherein each lug has a height less than the first height.

9. The pallet base structure of claim 1 wherein each base side member has a longitudinal space defined along the lower surface.

10. The pallet base structure of claim 1 wherein each base side member includes at least one shock dampener on the lower surface thereof.

11. A packaging system comprising a pallet base structure according to claim 1, a cover member configured to be positioned spaced from the pallet base structure, and at least one strap member configured to extend about the pallet base structure and the cover member such that the pallet base structure and the cover member are an interconnected unit.

12. The packaging system of claim 11 wherein at least one strap receiving slot is defined across the contact surface of the center deck, along each of the base side members, and across a top surface of the cover member.

13. The packaging system of claim 11 wherein the cover member includes a planar portion and a raised center portion defining a concave internal space.

14. The packaging system of claim 11 further comprising a wall system configured to be securely positioned between the pallet base structure and the cover.

15. The packaging system of claim 14 wherein the pallet base structure and the cover each define wall receiving slots.

* * * * *